US008564200B2

(12) United States Patent
Vrugt et al.

(10) Patent No.: US 8,564,200 B2
(45) Date of Patent: Oct. 22, 2013

(54) METAL HALIDE LAMP

(75) Inventors: Peter Jozef Vrugt, Eindhoven (NL); Changlong Ning, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 329 days.

(21) Appl. No.: 12/516,380

(22) PCT Filed: Nov. 27, 2007

(86) PCT No.: PCT/IB2007/054806

§ 371 (c)(1), (2), (4) Date: May 27, 2009

(87) PCT Pub. No.: WO2008/068666

PCT Pub. Date: Jun. 12, 2008

(65) Prior Publication Data

US 2010/0060165 A1 Mar. 11, 2010

(30) Foreign Application Priority Data

Dec. 1, 2006 (EP) ..... 06125187

(51) Int. Cl.
*H01J 17/20* (2012.01)

(52) U.S. Cl.
USPC ..... 313/638; 313/637; 313/643

(58) Field of Classification Search
USPC ..... 313/576, 637–643
See application file for complete search history.

(56) References Cited

U.S. PATENT DOCUMENTS

| | | | |
|---|---|---|---|
| 4,076,991 | A | 2/1978 | Datta |
| 5,973,453 | A | 10/1999 | Van Vliet |
| 6,737,808 | B1 | 5/2004 | Hendricx et al. |
| 7,423,380 | B2 | 9/2008 | Ota |
| 2003/0141818 | A1 | 7/2003 | Kelly |
| 2006/0208642 | A1 | 9/2006 | Baier et al. |

FOREIGN PATENT DOCUMENTS

| | | | |
|---|---|---|---|
| EP | 0215524 | A1 | 3/1987 |
| EP | 0271911 | A2 | 6/1988 |
| EP | 0587238 | A1 | 3/1994 |
| EP | 0899775 | A2 | 3/1999 |
| EP | 1134776 | A2 | 9/2001 |
| JP | 05334992 | A | 12/1993 |
| JP | 2005267960 | A | 9/2005 |
| WO | 2004008469 | A2 | 1/2004 |
| WO | 2005088675 | A2 | 9/2005 |
| WO | 2006046175 | A2 | 5/2006 |
| WO | 2006106464 | A2 | 10/2006 |

*Primary Examiner* — Anh Mai
*Assistant Examiner* — Zachary J Snyder

(57) ABSTRACT

The invention provides a metal halide lamp 1 wherein the concentration of the filling components fulfill a condition according to claim 1. Such a lamp is found to be a good alternative to existing high-pressure discharge lamps (Ceramic Discharge Metal halide lamps) based on rare earth fillings or other metal halide fillings. In addition, such a lamp can be dimmed without a substantial shift of the color point. Such a lamp can also have photometric properties that are substantially independent of the arrangement of the lamp and/or the external temperature.

10 Claims, 11 Drawing Sheets

METAL HALIDE LAMP

FIELD OF THE INVENTION

The present invention relates to a metal halide lamp comprising a ceramic discharge vessel, which discharge vessel encloses a discharge volume, comprises two electrodes, and contains an ionizable gas filling.

BACKGROUND OF THE INVENTION

Metal halide lamps are known in the art and are described, for example, in EP0215524 and WO2006/046175. Such lamps operate under high pressure and comprise ionizable gas fillings of, for example, NaI (sodium iodide), TlI (thallium iodide), $CaI_2$ (calcium iodide), and/or $REI_n$. $REI_n$ refers to rare earth iodides. Characteristic rare earth iodides for metal halide lamps are $CeI_3$, $PrI_3$, $NdI_3$, $DyI_3$, and $LuI_3$.

An important class of metal halide lamps are ceramic discharge metal halide lamps (CDM-lamps), which are described in the above-mentioned documents. The ionizable fillings (comprising rare earth salts) in the discharge vessels of such lamps are added in amounts that lead to a saturated vapor when the discharge lamp is operated, thereby leaving part of the filling in a condensed phase. A reason for adding the filling in an amount that will lead to a saturated vapor during use of the lamp may be the fact that salts may react with the discharge vessel wall and/or other elements within the discharge vessel during use, which leads to a reduction in the amount of filling. Hence, when aiming at a discharge lamp with a constant output, providing a saturated gas filling seems a prerequisite.

The lamps described in e.g. EP0215524 are said to provide a high luminous efficacy and a satisfactory color rendering. It is described that the discharge vessel comprises at least one halide of at least one of the elements Sc, La and the lanthanides; the elements Dy, Tm, Ho, Er and La being preferred. The examples describe discharge vessels with about 18.2-21.8 mg/cm$^3$ mercury and about 11.2-14.7 mg/cm$^3$ NaI, TlI and $DyI_3$. The halides are in excess; i.e. unevaporated sodium halide is still present during operation of the lamp. The coldest spot temperature is, for example, about 900° C. (1173 K).

SUMMARY OF THE INVENTION

It is desirable to provide an alternative metal halide lamp, preferably with improved (photometric) properties with respect to state of the art metal halide lamps. Furthermore, it is desirable to provide a metal halide lamp whose photometric properties are substantially independent over a wide range of temperatures within the discharge vessel. It is also desirable to provide a lamp that is dimmable. In dimming, it is further desirable to have no or no substantial shift of the color point. Hence, according to yet a further aspect, a metal halide lamp is provided which is dimmable, but without a substantial shift of the color point. Furthermore, it is desirable to have a lamp whose photometric properties are substantially independent of the ambient temperature. It is also desirable to have a lamp whose photometric properties are substantially independent of the luminaire. Yet, it is also desirable to have a lamp whose photometric properties are substantially independent of the spatial orientation of the lamp (such as a horizontal or vertical arrangement).

According to an aspect of the invention, the invention provides a metal halide lamp (a Ceramic Discharge Metal halide (CDM) lamp) comprising a ceramic discharge vessel and two electrodes (enclosed by the discharge vessel), the discharge vessel enclosing a discharge volume containing an ionizable gas filling, the ionizable gas filling comprising one or more components selected from the group consisting of LiI, NaI, KI, RbI, CsI, $MgI_2$, $CaI_2$, $SrI_2$, $BaI_2$, $ScI_3$, $YI_3$, $LaI_3$, $CeI_3$, $PrI_3$, $NdI_3$, $SmI_2$, $EuI_2$, $GdI_3$, $TbI_3$, $DyI_3$, $HoI_3$, $ErI_3$, $TmI_3$, $YbI_2$, $LuI_3$, TlI, $SnI_2$ and $ZnI_2$, wherein the concentration h of the respective components in the discharge vessel in μg/cm$^3$, fulfill the equation $\log h = A/T_{cs}^2 + B/T_{cs} + C + \log z$, wherein $T_{cs}$ is the minimum temperature within the discharge vessel in Kelvin during nominal operation of the lamp, and wherein A, B and C are defined in Table 1. Nominal operation in this description means operation at the maximum power and under conditions for which the lamp has been designed to be operated.

TABLE 1

A, B, C parameters for equation $\log h = A/T_{cs}^2 + B/T_{cs} + C + \log z$

| Component | $A*10^{-6}$ | $B*10^{-3}$ | C |
|---|---|---|---|
| LiI | −0.51 | −5.88 | 7.16 |
| NaI | −1.30 | −5.82 | 6.99 |
| KI | −2.51 | −3.48 | 5.66 |
| RbI | −2.04 | −4.95 | 6.48 |
| CsI | −1.40 | −5.72 | 7.13 |
| $MgI_2$ | −1.92 | −4.40 | 8.20 |
| $CaI_2$ | −3.45 | −5.99 | 6.83 |
| $SrI_2$ | −1.99 | −9.33 | 8.05 |
| $BaI_2$ | −2.15 | −10.00 | 8.47 |
| ScI3 | −17.70 | 18.76 | 0.16 |
| $YI_3$ | −7.96 | 0.43 | 6.41 |
| $LaI_3$ | −4.24 | −4.66 | 6.98 |
| $CeI_3$ | −3.15 | −7.37 | 9.36 |
| $PrI_3$ | −1.98 | −7.86 | 8.43 |
| $NdI_3$ | −4.29 | −4.42 | 6.58 |
| $SmI_2$ | −1.62 | −11.20 | 9.71 |
| $EuI_2$ | −1.95 | −10.50 | 8.95 |
| $GdI_3$ | −9.69 | 4.26 | 3.62 |
| $TbI_3$ | −9.41 | 4.09 | 3.59 |
| $DyI_3$ | −11.90 | 6.42 | 4.68 |
| $HoI_3$ | −9.48 | 3.15 | 5.61 |
| $ErI_3$ | −12.10 | 6.54 | 5.46 |
| $TmI_3$ | −3.12 | −5.25 | 7.64 |
| $YbI_2$ | −1.33 | −10.10 | 8.45 |
| $LuI_3$ | −9.00 | 3.37 | 5.38 |
| InI | −1.30 | −2.02 | 6.11 |
| TlI | −1.36 | −2.92 | 7.01 |
| $SnI_2$ | −1.99 | −1.14 | 6.39 |
| $ZnI_2$ | −2.58 | 0.65 | 5.23 |

wherein $T_{cs}$ is at least 1200 K and wherein z is between 0.001 and 2.

Such lamps according to the invention are found to be a good alternative to existing high-pressure discharge lamps based on rare earth fillings. In addition, such lamps are dimmable without a substantial shift of the color point (i.e. a reduction of the power below the maximum power preferably results a shift of the color point that stays within 10 SDCM (standard deviation of color matching)). Such lamps further also have photometric properties that are substantially independent of their spatial orientation and/or ambient temperature.

In a specific embodiment, the ionizable gas filling comprises one or more rare earth iodides. The one or more rare earth iodides comprise one or more iodides of rare earths selected from the group consisting of Sc, Y, La, Ce, Pr, Nd, Sm, Eu, Gd, Tb, Dy, Ho, Er, Tm, Yb, and Lu. According to another specific embodiment of the invention, the rare earth iodide comprises dysprosium iodide. Such lamps may especially be advantageous because Dy-based lamps are found to have good photometric properties, even in the red spectral region (see also below). In yet another specific embodiment, the rare earth iodide comprises cerium iodide. Especially lamps based on Dy, Ce, and also on Ho or Tm, are preferred because of their good photometric properties. In yet another embodiment, the ionizable gas filling comprises indium iodide. Lamps containing indium iodide are also found to have good photometric properties, while they are dimmable without a substantial shift of the color point. Hence, in another embodiment, the ionizable gas filling comprises indium iodide.

In a preferred embodiment, z is 1 or smaller, such as between 0.01 and 1. The filling will then be unsaturated at least at nominal operation conditions. The smaller the value of z, the further the operating power of the lamp can be reduced without the filling entering into saturation. This is advantageous for stable color properties over the lamp's operational range.

In an embodiment, the discharge vessel of the lamp according to the invention comprises one or more seals for sealing in, for example, one or more current lead-through conductors. Here, sealing-in refers to a sealing process based on a sealing frit, as known in the art. In a specific embodiment of the invention, the ionizable gas filling comprises one type of rare earth (i.e. rare earth salt), and the sealing material of the one or more seals comprises a ceramic sealing material based on a mixture of aluminum oxide, silicon dioxide, and a rare earth oxide, wherein the rare earth oxide of the sealing material is an oxide of the same type of rare earth as comprised in the ionizable gas filling. Any detrimental chemical interactions between rare earths of the sealing and rare earths of the ionizable gas filling can thus be reduced. In a specific embodiment, the ionizable gas filling comprises dysprosium iodide (as the one type of rare earth) and the one or more seal(s) is or are based on a mixture of aluminum oxide, silicon dioxide, and dysprosium oxide. In another specific embodiment, the ionizable gas filling comprises cerium iodide (as the one type of rare earth) and the one or more seal(s) is or are based on a mixture of aluminum oxide, silicon dioxide, and cerium oxide.

These and other aspects of the invention will be apparent from and elucidated with reference to the embodiments described herein after.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

As mentioned above, the lamp of the invention comprises a ceramic discharge vessel. This especially means that the walls of the ceramic discharge vessel preferably comprise a translucent crystalline metal oxide, like monocrystalline sapphire and densely sintered polycrystalline alumina (also known as PCA), YAG (yttrium aluminum garnet) and YOX (yttrium aluminium oxide), or translucent metal nitrides like AlN. The vessel wall may consist of one or more (sintered) parts, as known in the art (see also below).

Below, an embodiment of the lamp of the invention is described with reference to FIGS. 1-3. However, the lamp of the invention is not confined to the embodiments described below and/or schematically depicted in FIGS. 1-3.

Lamp 1 may be a high-intensity discharge lamp. In FIGS. 1-3, discharge vessels 3 are schematically depicted. The current lead-through conductors 20, 21 are sealed with two respective seals 10 (sealing fits, as known in the art). However, the invention is not limited to such embodiments. Lamps wherein one or both of the current lead-through conductors 20, 21 are, for example, directly sintered into the discharge vessel 3 may also be considered.

Figure 1:
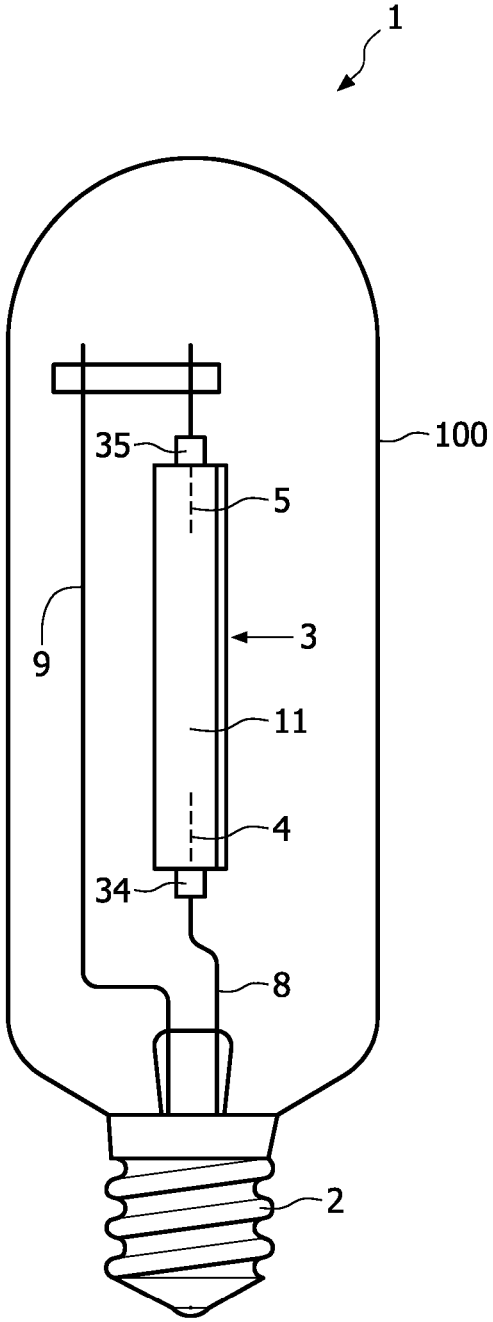
FIG. 1 schematically depicts an embodiment of a lamp according to the invention in a side elevation.
Figure 2:
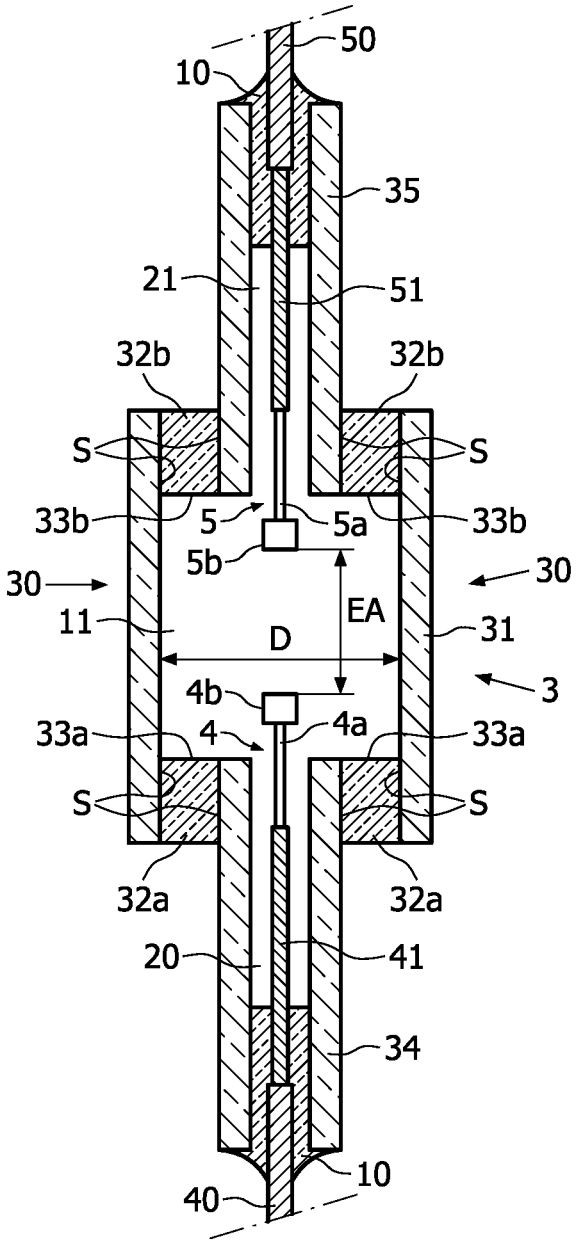
FIG. 2 schematically depicts an embodiment of the discharge vessel of the lamp of FIG. 1 in more detail.
Figure 3:
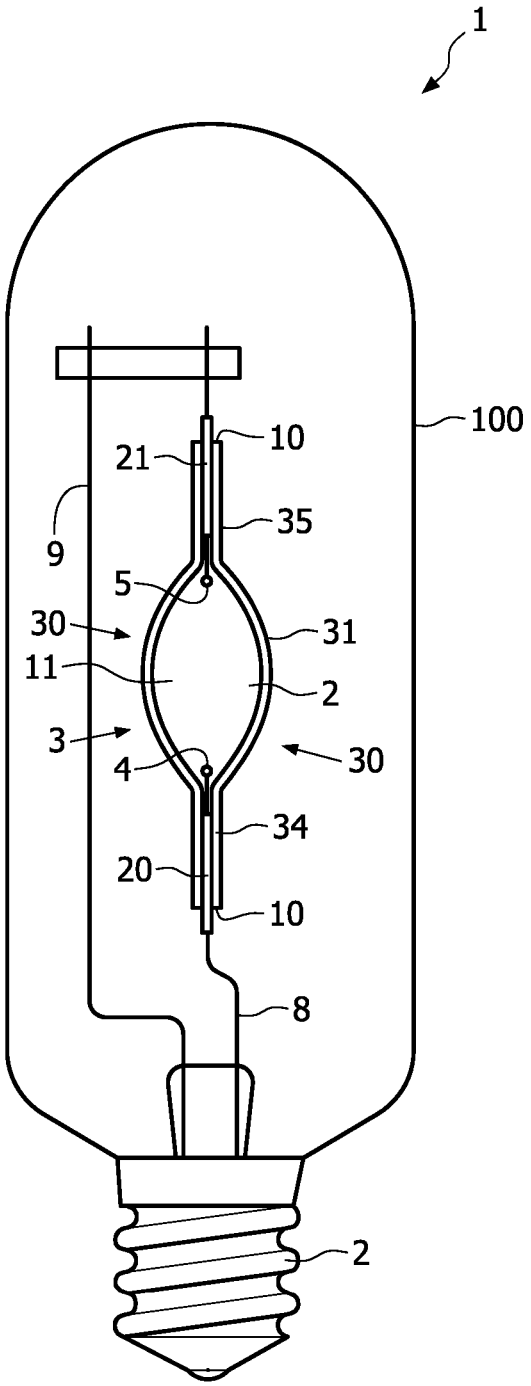
FIG. 3 schematically depicts an embodiment having an alternatively shaped discharge vessel.

Herein, specific embodiments are described in more detail wherein both current lead-through conductors 20, 21 are sealed into discharge vessel 3 by means of seals 10 (see also FIGS. 1-3). Two electrodes 4, 5, for example tungsten electrodes, with tips 4*b*, 5*b* at a mutual distance EA are arranged in the discharge space 11 so as to define a discharge path between them. The cylindrical discharge vessel 3 has an internal diameter D at least over the distance EA. Each electrode 4, 5 extends inside the discharge vessel 3 over a length forming a tip to bottom distance between the vessel wall 31 (i.e. reference signs 33*a*, 33*b*, respectively) and the electrode tip 4*b*, 5*b*. The discharge vessel 3 may be closed at either side by means of end wall portions 32*a*, 32*b* forming end faces 33*a*, 33*b* of the discharge space. The end wall portions 32*a*, 32*b* may each have an opening in which a respective ceramic projecting plug 34, 35 is fitted in a gastight manner in the end wall portion 32*a*, 32*b* by means of a sintered joint S. The discharge vessel 3 is closed by means of these ceramic projecting plugs 34, 35, each of which encloses a current lead-through conductor 20, 21 (in general including respective components 40, 41; 50, 51, which are explained in more detail below) to the electrode 4, 5 positioned in the discharge vessel 3 with a narrow intervening space and is connected to this conductor in a gastight manner by means of a melting-ceramic joint 10 (further indicated as seal 10) at an end remote from the discharge space 11. Here, the ceramic discharge vessel wall 30 comprises vessel wall 31, ceramic projecting plugs 34, 35, and end wall portions 32*a*, 32*b*.

The discharge vessel 3 is surrounded by an outer bulb 100 which is provided with a lamp cap 2 at one end. A discharge will extend between the electrodes 4 and 5 when the lamp 1 is operating. The electrode 4 is connected via a current conductor 8 to a first electrical contact forming part of the lamp cap 2. The electrode 5 is connected via a current conductor 9 to a second electrical contact forming part of the lamp cap 2.

The ceramic projecting plugs 34, 35 each narrowly enclose a current lead-through conductor 20, 21 of a relevant electrode 4, 5 having electrode rods 4*a*, 5*a* which are provided with tips 4*b*, 5*b*, respectively. Current lead-through conductors 20, 21 enter discharge vessel 3. In an embodiment, the current lead-through conductors 20, 21 may each comprise a halide-resistant portion 41, 51, for example in the form of a Mo—$Al_2O_3$ cermet, and a portion 40, 50 which is fastened to a respective end plug 34, 35 in a gas tight manner by means of seals 10. Seals 10 extend over some distance, for example approximately 1-5 mm, over the Mo cermets 41, 51 (during sealing, ceramic sealing material penetrates into the free space within the respective end plugs 34, 35). It is possible for the parts 41, 51 to be formed in an alternative manner instead of from a Mo—$Al_2O_3$ cermet. Other possible constructions are known, for example, from EP0587238 (incorporated herein by reference, wherein a Mo coil-to-rod configuration is described). A particularly suitable construction was found to be a halide-resistant material. The parts 40, 50 are made from a metal whose coefficient of expansion corresponds very well to that of the end plugs 34, 35. Niobium (Nb) is chosen, for example, because this material has a coefficient of thermal expansion corresponding to that of the ceramic discharge vessel 3.

FIG. 3 shows another embodiment of the lamp according to the invention. Lamp parts corresponding to those shown in FIGS. 1 and 2 have been given the same reference numerals. The discharge vessel 3 has a shaped wall 30 enclosing the discharge space 11. The shaped wall 30 forms an ellipsoid in the case shown here. Compared with the embodiment described above (see also FIG. 2), the wall 30 is a single entity, in fact comprising wall 31, respective end plugs 34, 35, and end wall portions 32*a*, 32*b* (shown as separate parts in FIG. 2). A specific embodiment of such a discharge vessel 3 is described in more detail in WO06/046175. Alternatively, other shapes, like for example spheroid, are equally possible.

Herein, wall 30, which in the embodiment schematically depicted in FIG. 2 may include ceramic projecting plugs 34, 35, end wall portions 32*a*, 32*b*, and wall 31, or wall 30, as schematically depicted in FIG. 3, is a ceramic wall, which is to be understood to mean a wall of translucent crystalline metal oxide or translucent metal nitrides like AlN (see also above). According to the state of the art, these ceramics are well suited to form translucent discharge vessel walls of vessel 3. Such translucent ceramic discharge vessels 3 are known, see for example EP215524, EP587238, WO05/088675, and WO06/046175. In a specific embodiment, the discharge vessel 3 comprises translucent sintered $Al_2O_3$, i.e. wall 30 comprises translucent sintered $Al_2O_3$. In the embodiment schematically depicted in the Figures, wall 30 may also comprise sapphire.

The ionizable filling in the lamp 1 of the invention may comprise, for example, one or more of NaI, TlI, $CaI_2$, and $REI_n$ (rare earth iodide) as its components, but may also comprise other gas filling components such as LiI, etc. $REI_n$ refers to rare earth compounds such as one or more of $CeI_3$, $PrI_3$, $NdI_3$, $SmI_2$, $EuI_2$, $GdI_3$, $TbI_3$, $DyI_3$, $HoI_3$, $ErI_3$, $TmI_3$, $YbI_2$, and $LuI_3$, but in an embodiment also includes one or more of Y (yttrium) iodides, Sc iodides and La iodides. Furthermore, the discharge space 11 contains Hg (mercury) and a starter gas such as Ar (argon) or Xe (xenon), as known in the art. Characteristic Hg amounts are between about 1 and 100 $mg/cm^3$ Hg, especially in the range of about 5-20 $mg/cm^3$ Hg; characteristic pressures are in the range of about 2-50 bar. Preferably, the amount of mercury in the discharge vessel 3 is chosen to provide a mercury gas at nominal use without condensation of mercury, i.e. the mercury vapor is also unsaturated. Mercury and a starter gas are implied, as known to those skilled in the art, and are not further discussed. In principle, the lamp of the invention may also be operated free of mercury, but Hg is present in the discharge vessel 3 in the preferred embodiments. During steady-state burning, long-arc lamps in general have a pressure of a few bar, whereas short-arc lamps may have pressures in the discharge vessel of up to about 50 bar. Characteristic powers of the lamp are between about 10 and 1000 W, preferably in the range of about 20-600 W.

Figure 4:
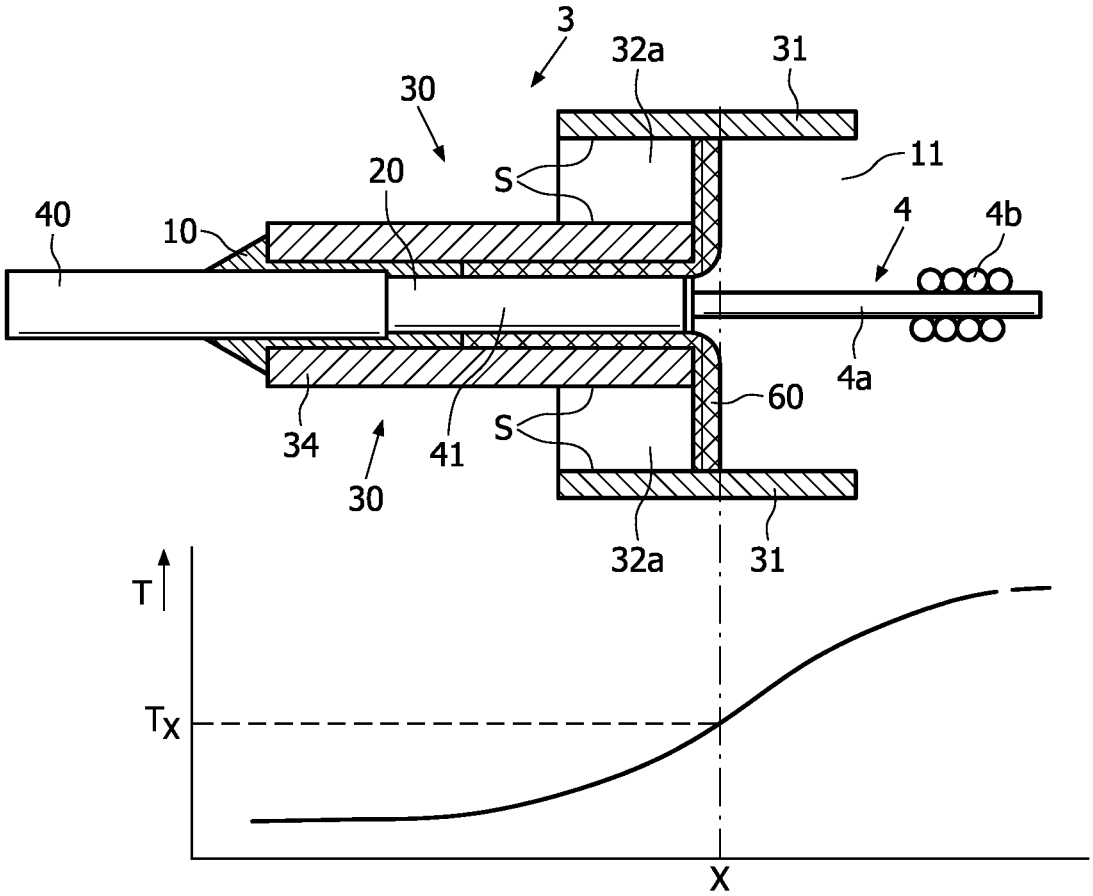
FIG. 4 schematically depicts a configuration wherein salt of the ionizable gas filling is present in at least part of the discharge vessel.
Figure 5:
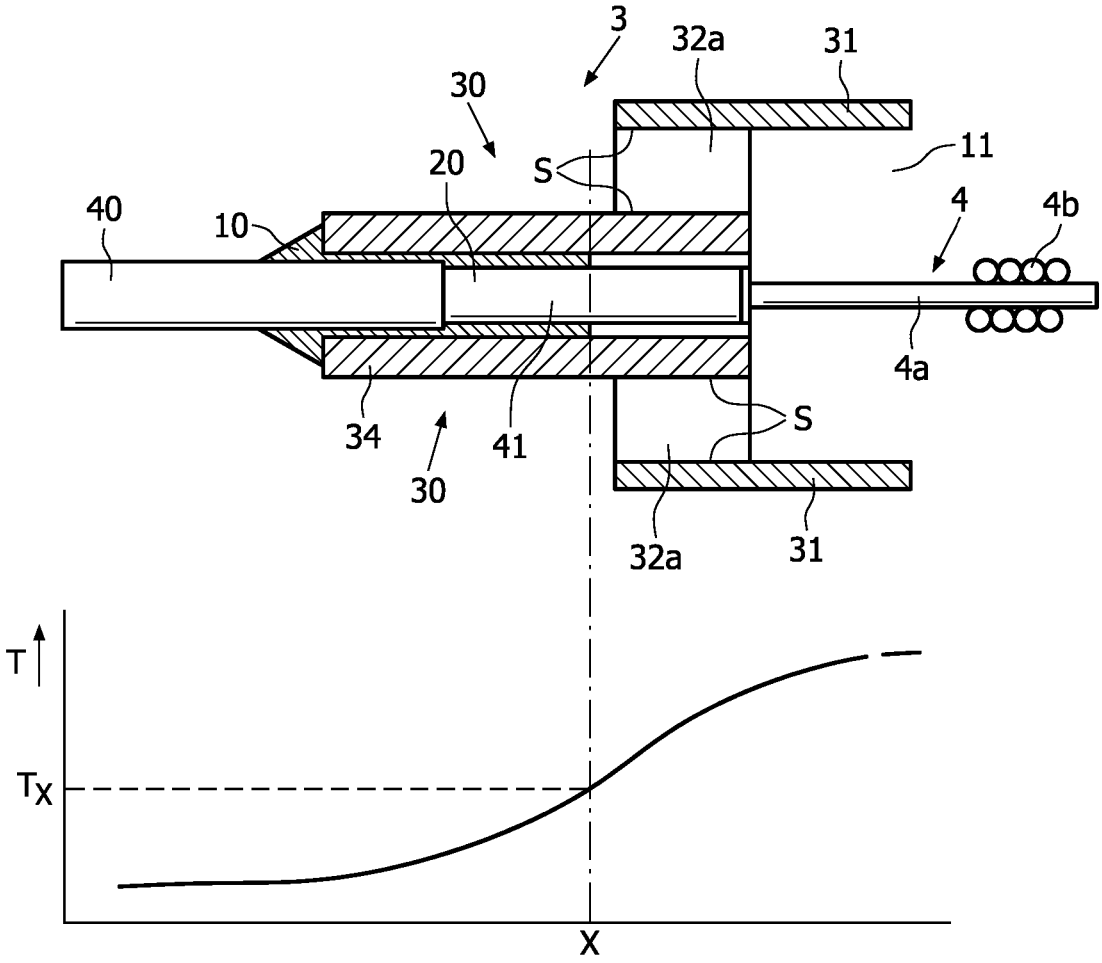
FIG. 5 schematically indicates how the temperature may vary over the discharge vessel wall.

A portion of discharge vessel 3 of FIG. 2 is depicted in more detail in FIGS. 4 and 5. The horizontal orientation does not necessarily imply that the lamp 1 is to be operated in this orientation. In this Figure, the presence of condensed material for the ionizable gas filling is referenced 60 (as it is the case for prior art lamps, even when such a prior art lamp is operated). FIG. 4 schematically depicts a situation wherein the voids between electrode 4 and projecting end plug 34 contain condensed material (such as iodide salts), even during operation of the lamp. This is especially a situation that may be found in known lamps, since such lamps apply largely oversaturated fillings. During operation of prior art high pressure discharge lamps, condensed material is still present in the discharge vessel. This leads to a situation that during operation the discharge gas is saturated with iodides and a metal halide salt "pool" is formed at the coldest spot.

By contrast, the present invention provides a discharge lamp 1 in an embodiment wherein the ionizable filling components are dosed in such small amounts that no or no substantial condensation of the halide filling components will occur during operation of the lamp, at least during nominal operation of the lamp, nominal operation being operation of the lamp at the maximum power and under conditions for which it was designed. Hence, the ionizable filling components are preferably present in the discharge vessel 3 in such an amount that a substantially unsaturated gas is obtained during nominal operation. This implies that during nominal operation of the lamp, preferably no or substantially no condensed components of the ionizable gas filling, like $REI_n$ and/or InI, are found within the discharge vessel 3. Herein, the term "nominal operation" refers to the operation of the lamp 1 at the rated power. For example, a commercially available lamp of 50 W (i.e. rated at 50 W) is used nominally at 50 W. Equivalent terms for "nominal operation" known in the art are "rated power", "maximum power" or "nominal power". The term "during operation" refers to the situation wherein the lamp 1 is operating, especially under the prescribed conditions such as ambient temperature, indicated power, current, and frequency. It especially refers to the situation wherein the lamp 1 is operating at a substantially constant level after an initial start-up, for example after about 1 minute (steady state). Then, the lamp is used at stable operation due to a stable arc. The term "unsaturated" refers to the situation wherein the gas within the discharge vessel 3 during nominal operation is unsaturated. This means that during operation, substantially no iodides of the rare earth(s) or other gas filling component condense inside the discharge vessel 3. Hence, during nominal operation of the lamp substantially all components within discharge vessel 3 are in the gas phase.

These favorable conditions are especially achieved in an embodiment in that a specific concentration is selected for the components and the appropriate minimum temperature within discharge vessel 3 is selected for obtaining nominal operation, see also Table 2 below.

The concentration of the respective components can be calculated from the above equation, whereupon the ceramic discharge vessel 3 and lamp 1 are arranged so as to have a coldest spot temperature at nominal operation of a predetermined value (which is at least 1200 K). The term "respective components" refer to the fact that of each individual component of the gas filling containing one or more components selected from the group consisting of LiI, NaI, KI, RbI, CsI, $MgI_2$, $CaI_2$, $SrI_2$, $BaI_2$, $ScI_3$, $YI_3$, $LaI_3$, $CeI_3$, $PrI_3$, $NdI_3$, $SmI_2$, $EuI_2$, $GdI_3$, $TbI_3$, $DyI_3$, $HoI_3$, $ErI_3$, $TmI_3$, $YbI_2$, $LuI_3$, InI, TlI, $SnI_2$ and $ZnI_2$, the concentration has to be calculated from the above equation according to the parameters given in Table 1. It appears that the advantages of the invention over prior art lamps can be obtained when the concentrations of the respective components of the gas filling fulfill this equation. Standard filling components Hg and a starter gas are not included in the Table; these filling components are in the gas phase during operation (see also above).

Good photometric properties are obtained with a concentration h wherein z is 2 or smaller. The filling components are in the gas phase, especially in the preferred embodiment wherein z is 1 or smaller. In general, the lower z, the less the properties of the lamp depend upon its thermal loading. If the filling comprises one or more elements selected from the group consisting of Mg, Sc, Er, In, Tl, Sn and Zn, the concentrations h of the respective components fulfill the above equation wherein z is 2 or smaller, more preferably z is 1.5 or smaller, even more preferably 1 or smaller, still more preferably 0.5 or smaller, even more preferably 0.1 or smaller, such as 0.001 to 0.1. If the filling comprises one or more elements selected from the group consisting of Y, Dy, Ho, Lu and Li, the concentrations h of the respective components fulfill the above equation wherein z is 2 or smaller, more preferably z is 1.5 or smaller, even more preferably z is 1 or smaller, even more preferably 0.5 or smaller, such as 0.001 to 0.5, yet even more preferably, z is 0.1 or smaller, such as 0.001 to 0.1. If the filling comprises one or more elements selected from the group consisting of Ce and Tm, the concentrations h of the respective components fulfill the above equation wherein z is 2 or smaller, more preferably z is 1.5 or smaller, even more preferably 1 or smaller, yet even more preferably z is 0.5 or smaller, such as 0.001 to 0.5, even more preferably z is 0.1 or smaller, such as 0.001 to 0.1. If z is above approximately 1 for a component of the gas filling, the component will start to form condensation inside the discharge vessel 3 at the coldest spot, i.e. at the coldest spot temperature. For example with a filling containing InI, when the coldest spot temperature during operation is 1400 K, a concentration of more than about 10,100 $\mu g/cm^3$ may lead to condensation of InI in the discharge vessel 3. In this way, the disadvantages of largely oversaturated gas filling components are avoided, while the good photometric properties of the invention are achieved.

Characteristic mean temperatures and pressures of the gas in the discharge vessel 3 of lamp 1 according to the invention during operation are about 2000-3000 K, such as about 2500 K, and about 2-50 bar, respectively. However, there are temperature differences within the discharge vessel 3. The temperature will be relatively high close to electrode tips 4*b*, 5*b*. During operation the temperature within the discharge vessel may vary from as high as about 6000 K in the core of the arc to a characteristic temperature of about 3000 K at the electrode tip, to a characteristic temperature of about 1600 K of the hottest part of the discharge vessel wall 30, and to a characteristic temperature near, for example, an end part of the discharge vessel 3, the so cold coldest spot temperature (see also above). In general, the temperature will be lower at the (end) of projecting plugs 34, 35 than at the internal surface of wall 30 (FIG. 3) or wall 31 (FIG. 2), see also FIG. 5. The location of the discharge vessel 3 with the lowest temperature is denoted the coldest spot, and its temperature is sometimes indicated as $T_{cs}$ or $T_{kp}$ (see EP0215524). The phrase "minimum temperature of at least 1200 K during use of the lamp" indicates that the temperature at the coldest spot of the discharge vessel 3 is at least 1200 K during operation of the lamp. It especially refers to lamp operation at maximum power, i.e. nominal operation. At nominal operation the coldest spot temperature is at least about 1200 K, preferably even higher. However, during start-up or, for example, when the lamp is operated in a dimmed state, the coldest spot temperature may be lower. The coldest spot can be determined by measuring the local wall temperature of wall 30 of discharge vessel 3. The lowest temperature measured then is taken as the coldest spot temperature. This determination is known in the art and is briefly discussed below.

In this description and claims, the coldest spot temperature $T_{cs}$ of the discharge vessel is defined as the lowest temperature measured according to the above-described method when the lamp is in nominal operation.

FIG. 5 schematically shows the same portion of the discharge vessel 3 as schematically indicated in FIG. 4, with a schematic indication of the temperature gradient. The discharge vessel 3 encloses volume 11, i.e. the volume wherein the components of the gas filling are enclosed and wherein these components form the gas during use of the lamp 1. In the embodiment of FIG. 5, this volume is the volume enclosed by wall 30, i.e. wall 31, end parts 32*a* (only one side of the discharge vessel 3 is shown in this schematic FIG.), projecting plug 34, and seal 10 (see also FIGS. 2 and 3). The temperature along wall 30 can be determined by measuring the emission of the ceramic material. This temperature is indicated as a function of position x. In the schematic FIG. 5, the coldest spot is found at the end of the ceramic projecting plug 34, i.e. where the discharge volume 11 ends and seal 10 commences. This position is indicated with x, and the temperature at this point, the minimum temperature within discharge vessel 3 or the coldest spot temperature, is indicated with $T_x$. This temperature $T_x$ is at least 1200 K during operation, at least during nominal operation. The position of the coldest spot depends on lamp orientation (such as horizontal or vertical). The schematic drawing of FIG. 4 refers to a prior art situation with a large amount of saturation, whereas the schematic drawing of FIG. 5 refers to discharge vessel 3 of lamp 1 according to the invention.

In general, prior art lamps may have a coldest spot temperature of about 900-1100 K during use. Temperatures higher than about 1100 K can only be achieved in ceramic discharge vessels 3, since the quartz of quartz vessels deteriorates at temperatures above about 1100 K. The temperature of the coldest spot in discharge vessel 3 of lamp 1 according to the invention, however, is at least about 1200 K in a preferred general condition. In a specific embodiment, the minimum temperature (or coldest spot temperature) is between about 1200 and 1600 K. Especially good results are obtained when discharge vessel 3 is arranged to have a minimum temperature of at least about 1300 K during operation of the lamp, preferably at least about 1350 K, even more preferably at least about 1400 K, i.e. the minimum temperature (or coldest spot temperature) is at least about 1300 K, 1350, or 1400 K, respectively. In a more specific embodiment, the discharge vessel 3 is arranged to have a minimum temperature in the range of 1350-1500 K during nominal operation of the lamp. In general, it is found that the higher the coldest spot temperature, the more the lamp can be dimmed. It is further found that the higher the coldest spot temperature, the more independent lamp 1 is of the external temperature or orientation of the discharge vessel 3. The phrase "the discharge vessel 3 is arranged to have a minimum temperature of at least 1200 K" refers to the design of lamp 1 and discharge vessel 3 which allows the lamp 1 to achieve the minimum temperatures for the coldest spot mentioned herein (especially at nominal use) during operation. When dimming the lamp 1 to powers lower than at nominal operation (lower than the rated power), the temperature of the coldest spot will drop. Depending on the concentration, this may imply condensation of one or more components of the filling. Hence, $T_{cs}$ may vary during operation. The filling concentration is calculated, however, with a view to nominal operation. At this nominal operation, a $T_{cs}$ value is obtained of at least 1200 K or higher.

In a specific embodiment, however, a salt concentration is selected that is about 10%, more preferably 1% of the saturation concentration (z is about 1) of the lamp at its maximum output (i.e. nominal operation), i.e. z is 0.1 or 0.01, respectively. In this way condensation can be substantially prevented even during dimming. For example, assuming a $DyI_3$ filling of 46.90 μg/cm$^3$ (z=0.01) and a coldest spot temperature at nominal operation of 1500 K, even if dimming should lead to a lowering of the coldest spot temperature to about 1300 K, or even as low as 1200K, the $DyI_3$ concentration will still be below saturation (see also Table 2 below). Hence, such lamps will in general be dimmable down to at least 30% of their maximum power without a substantial worsening of photometric properties such as (a substantial) shift of the color point.

In Table 2, the maximum amount is given in μg/cm$^3$ (μg/cc) for a number of iodides that can be added to the discharge vessel (without resulting in partially condensed substances during operation of the lamp) for providing an unsaturated gas (with respect to the specific iodide) if the coldest spot temperature of the lamp's discharge vessel exceeds the temperatures indicated (1100 K, 1200 K, 1300 K, 1400 K, 1500 K and 1600 K). In this Table, z=1, a preferred value. The values for 1100 K are included for reasons of comparison.

TABLE 2 embodiments of maximum concentration (μg/cm$^3$) of $REI_n$, InI, NaI, and other iodides.

| Component | 1100 K | 1200 K | 1300 K | 1400 K | 1500 K | 1600 K |
|---|---|---|---|---|---|---|
| LiI | $2.48*10^1$ | $8.06*10^1$ | $2.17*10^2$ | $5.02*10^2$ | $1.03*10^3$ | $1.93*10^3$ |
| NaI | 4.23 | $1.73*10^1$ | $5.56*10^1$ | $1.48*10^2$ | $3.41*10^2$ | $7.01*10^2$ |
| KI | 2.64 | $1.04*10^1$ | $3.15*10^1$ | $7.83*10^1$ | $1.68*10^2$ | $3.20*10^2$ |
| RbI | 3.69 | $1.54*10^1$ | $4.97*10^1$ | $1.31*10^2$ | $2.97*10^2$ | $5.98*10^2$ |
| CsI | 5.93 | $2.46*10^1$ | $7.97*10^1$ | $2.14*10^2$ | $4.95*10^2$ | $1.02*10^3$ |
| $MgI_2$ | $4.10*10^2$ | $1.58*10^3$ | $4.78*10^3$ | $1.20*10^4$ | $2.59*10^4$ | $5.01*10^4$ |
| $CaI_2$ | $3.41*10^{-2}$ | $2.77*10^{-1}$ | 1.51 | 6.18 | $2.01*10^1$ | $5.47*10^1$ |
| $SrI_2$ | $8.39*10^{-3}$ | $7.82*10^{-2}$ | $4.96*10^{-1}$ | 2.35 | 8.82 | $2.76*10^1$ |
| $BaI_2$ | $4.00*10^{-3}$ | $4.40*10^{-2}$ | $3.20*10^{-1}$ | 1.70 | 7.04 | $2.40*10^1$ |
| $ScI_3$ | $3.78*10^2$ | $3.12*10^3$ | $1.29*10^4$ | $3.33*10^4$ | $6.20*10^4$ | $9.20*10^4$ |
| $YI_3$ | 1.66 | $1.73*10^1$ | $1.07*10^2$ | $4.50*10^2$ | $1.43*10^3$ | $3.69*10^3$ |
| $LaI_3$ | $1.73*10^{-1}$ | 1.41 | 7.67 | $3.06*10^1$ | $9.70*10^1$ | $2.57*10^2$ |
| $CeI_3$ | 1.16 | $1.09*10^1$ | $6.80*10^1$ | $3.12*10^2$ | $1.13*10^3$ | $3.38*10^3$ |
| $PrI_3$ | $4.52*10^{-1}$ | 3.25 | $1.65*10^1$ | $6.48*10^1$ | $2.07*10^2$ | $5.62*10^2$ |
| $NdI_3$ | $1.04*10^{-1}$ | $8.25*10^{-1}$ | 4.37 | $1.71*10^1$ | $5.32*10^1$ | $1.38*10^2$ |
| $SmI_2$ | $1.55*10^{-2}$ | $1.79*10^{-1}$ | 1.37 | 7.65 | $3.34*10^1$ | $1.19*10^2$ |
| $EuI_2$ | $6.21*10^{-3}$ | $7.01*10^{-2}$ | $5.24*10^{-1}$ | 2.85 | $1.21*10^1$ | $4.22*10^1$ |
| $GdI_3$ | $3.08*10^{-1}$ | 2.78 | $1.47*10^1$ | $5.28*10^1$ | $1.43*10^2$ | $3.16*10^2$ |
| $TbI_3$ | $3.35*10^{-1}$ | 2.87 | $1.45*10^1$ | $5.07*10^1$ | $1.35*10^2$ | $2.92*10^2$ |
| $DyI_3$ | 4.80 | $5.84*10^1$ | $3.78*10^2$ | $1.56*10^3$ | $4.69*10^3$ | $1.11*10^4$ |
| $HoI_3$ | 4.35 | $4.48*10^1$ | $2.65*10^2$ | $1.05*10^3$ | $3.14*10^3$ | $7.51*10^3$ |
| $ErI_3$ | $2.51*10^1$ | $3.17*10^2$ | $2.12*10^3$ | $8.97*10^3$ | $2.74*10^4$ | $6.54*10^4$ |
| $TmI_3$ | 1.98 | $1.27*10^1$ | $5.78*10^1$ | $2.01*10^2$ | $5.74*10^2$ | $1.40*10^3$ |
| $YbI_2$ | $1.50*10^{-2}$ | $1.31*10^{-1}$ | $7.94*10^{-1}$ | 3.66 | $1.35*10^1$ | $4.21*10^1$ |
| $LuI_3$ | 9.96 | $8.54*10^1$ | $4.37*10^2$ | $1.54*10^3$ | $4.17*10^3$ | $9.21*10^3$ |
| InI | $1.58*10^3$ | $3.34*10^3$ | $6.12*10^3$ | $1.01*10^4$ | $1.53*10^4$ | $2.19*10^4$ |
| TlI | $1.71*10^3$ | $4.29*10^3$ | $9.11*10^3$ | $1.70*10^4$ | $2.88*10^4$ | $4.51*10^4$ |
| $SnI_2$ | $5.12*10^3$ | $1.14*10^4$ | $2.17*10^4$ | $3.63*10^4$ | $5.57*10^4$ | $7.95*10^4$ |
| $ZnI_2$ | $4.83*10^3$ | $9.46*10^3$ | $1.58*10^4$ | $2.37*10^4$ | $3.26*10^4$ | $4.22*10^4$ |

The values listed in Table 1 above are preferred values for the upper limits for the concentrations of the respective compounds in discharge vessel 3 of lamp 1, wherein the minimum temperature (coldest spot temperature) of discharge vessel 3 is as indicated in the Table at least during nominal operation. For example, assuming a preferred embodiment with a minimum temperature of the discharge vessel 3 of 1300 K, i.e. the coldest spot temperature of discharge vessel 3 is 1300 K or higher, and with only $DyI_3$ as the RE gas (in addition to mercury gas and a noble gas), a preferred maximum concentration will be about 378 μg/cm$^3$ (z=1). In another example, assuming a preferred embodiment comprising a combination of Dy and Tl, Dy will preferably be present in discharge vessel 3 in the form of $DyI_3$ at a concentration of ≤378 μg/cm$^3$ and Tl in the form of TlI at a concentration of ≤9110 μg/cm$^3$. If lamp 1 is arranged to have a coldest spot temperature higher than 1300 K, these values may be higher, as can be derived from Table 2. In yet another example, a preferred embodiment relates to a lamp based on Dy, Tl and Sn. In such an embodiment, the lamp is arranged to have a coldest spot temperature of the discharge vessel 3 of at least 1300 K, and the preferred concentrations of $DyI_3$, TlI and $SnI_2$ are ≤378 μg/cm$^3$, 9110 μg/cm$^3$, and $2.17*10^4$ μg/cm$^3$, respectively. In a preferred embodiment, accordingly, the ionizable gas filling of the metal halide lamp according to the invention comprises one or more rare earth iodides selected from the group consisting of dysprosium iodide and holmium iodide, and the ionizable gas filling comprises 10-370 μg/cm$^3$, more preferably 10-300, even more preferably 10-250 μg/cm$^3$ of the respective one or more rare earth iodides selected. In an embodiment wherein the ionizable gas filling comprises one or more rare earth iodides selected from the group consisting of cerium iodide and thulium iodide, the ionizable gas filling preferably comprises ≤65 μg/cm$^3$, more preferably ≤60 μg/cm$^3$, even more preferably ≤50 μg/cm$^3$ of the one or more rare earth iodides. Preferred maximum values, including the values for non-RE components of the ionizable gas filling, are the values listed in the column headed 1300 K in Table 2.

It further appears that, given the condition that the gas filling is substantially unsaturated, parameters such as the geometry of the discharge vessel are less important here than for state of the art lamps. If the temperature of the coldest spot is high enough, furthermore, effects of lamp conditions such as orientation, ambient temperature, luminaire, etc., are of minor importance. That means that the conditions defined herein can offer those skilled in the art more freedom in designing the discharge vessel 3 in an embodiment than would be possible for discharge vessels of lamps that are conventionally operated.

It further appears that the higher the temperature, and the lower the salt concentration with respect to the saturated state, the better the lamp 1 will be dimmable. The lamp 1 according to an embodiment of the invention can typically be dimmed from 100 of its intensity at nominal operation to about 70%, more preferably 50% of said intensity. In an embodiment, the metal halide lamp 1 according to the invention is dimmable, especially over a range of 100-70%, more preferably 100-50% of its intensity at nominal operation without a substantial shift of the color point. The expression "without a substantial shift of the color point" refers to a shift of the color point which is not larger than 10 SDCM, especially not larger than 5 SDCM. A preferred tolerance is not larger than about 2-5 SDCM.

In a specific embodiment of the invention, the rare earth iodide comprises dysprosium iodide. Such lamps may especially provide good characteristics. In yet another specific embodiment, the rare earth iodide comprises cerium iodide. Lamps 1 comprising a discharge vessel 3 containing cerium iodide may further contain one or more iodides selected from, for example, the group consisting of thallium, lithium, tin, calcium, indium and sodium iodides in discharge vessel 3. Preferred fillings comprise Dy, Ce, Ho or Tm as rare earth components. Further preferred fillings are based on Dy—Tl, Ce—Na, H—Tl, or Tm—Na. Yet other preferred fillings are based on Dy—Tl—Sn, Ce—Tl—Na, Ho—Tl—Na, Ho—Tl—Sn or Tm—Tl—Sn. Other preferred fillings are based on Na—Tl—Ce—Ca, Na—Tl—Er, or Na—Tl—Pr. Fillings based on Dy as rare earth component are especially preferred. In another preferred embodiment, the filling comprises indium iodide. Preferred fillings are based on Na—Tl—In or In—Sn.

As was noted above, the discharge vessel 3 of lamp 1 in an embodiment of the invention may comprise one or more seals 10, for example for sealing one or more current lead-through conductors 20, 21 into respective projecting plugs 34, 35. Seals 10, known to those skilled in the art, usually comprise ceramic sealing materials, see for example U.S. Pat. No. 4,076,991 and EP0587238. Such ceramic sealing materials are generally based on a mixture of oxides which are pressed and sintered into a product in the form of a ring. The seal 10 is created by heating of the frit ring mounted on the exterior ends of projecting end plugs 34, 35 and arranged around current lead-through conductors 20, 21 to a temperature at which the sealing material melts and the ceramic seal is formed. In a preferred embodiment, the sealing material of seal 10 is based on a mixture of aluminum oxide, silicon dioxide, and a rare earth oxide as described, for example, in U.S. Pat. No. 4,076,991.

In a preferred embodiment, the ionizable gas filing contains one type of rare earth and the sealing material of the one or more sealings 10 comprises a ceramic sealing material based on a mixture of aluminum oxide, silicon dioxide, and a rare earth oxide, wherein the rare earth oxide of the sealing material is an oxide of the same rare earth as comprised in the ionizable gas filling. In yet another specific variant, the ionizable gas filling comprises dysprosium iodide and the seal comprises dysprosium oxide as a rare earth oxide. In yet another specific variant, the ionizable gas filling comprises cerium iodide and the seal comprises cerium oxide as a rare earth oxide. Hence the ionizable gas filling comprise one type of rare earth in an embodiment, especially in those embodiments in which the lamp 1 comprises seals 10.

Lamps 1 according to the invention may be used in applications such as accent lighting in shops, indoor and outdoor sports facilities, studio, theatre, and disco lighting, motorcar headlights, projection purposes, and also for general lighting purposes such as street and area lighting.

EXAMPLES

Example 1

Example of Lamp/Discharge Vessel According to the Invention

Figure 7:
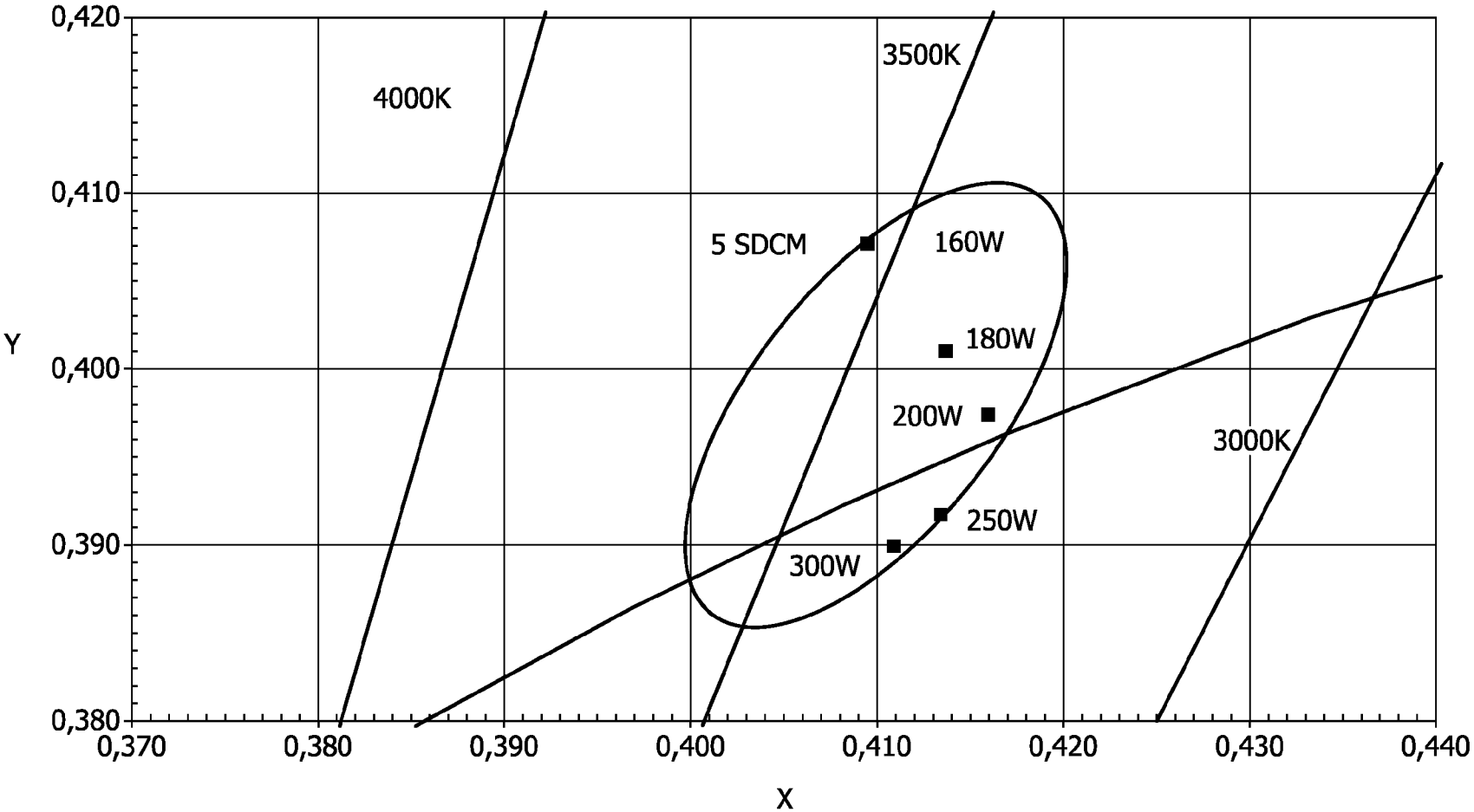
FIG. 7 shows the dimmability of the lamp of FIG. 6 at powers of 160-300 W. The ellipse indicates the 5 standard deviation of color matching (5 SDCM) range.
Figure 8:
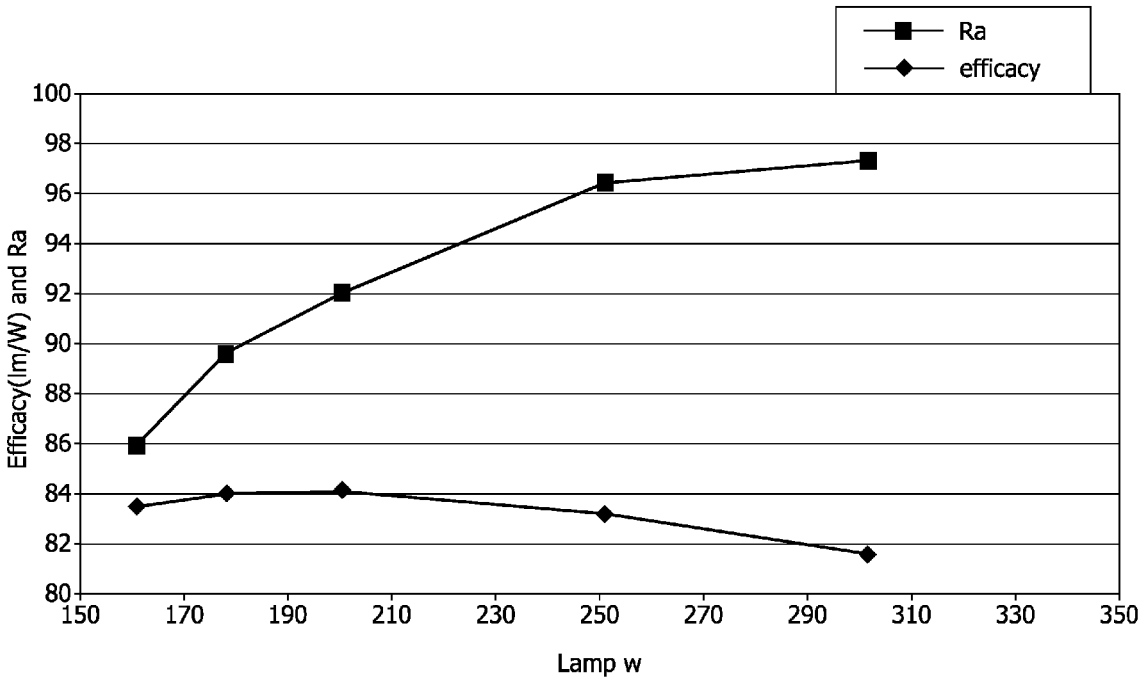
FIG. 8 shows the luminous efficacy and the general color rendering index (Ra) of the lamp of FIG. 6 at powers of 160-300 W.

A lamp with discharge vessel 3 having a volume of 1.8 cm$^3$ was made. The discharge vessel 3 contained the following filling: 140 μg NaI, 980 μg TlI, 120 μg $DyI_3$, 30 mg Hg, and 300 mbar Ar. Hence, the concentration of $DyI_3$=67 μg/cm$^3$<1560 μg/cm$^3$ (1400 K), the concentration of TlI=544 μg/cm$^3$<17,000 μg/cm$^3$ (1400 K), and the concentration of NaI=78 μg/cm$^3$<148 μg/cm$^3$ (1400 K). The lamp was operated at 220 V, 50 Hz, at room temperature environment. The coldest spot temperature at nominal power (300 W) was 1400 K (±50 K); at 160 W, the coldest spot temperature was about 1150 K. The color point, the general color rendering index (Ra), and the luminous efficacy as a function of the power are shown in FIGS. 7-8. The wall load was about 75 W/cm$^2$ during operation at 300 W. Hence, the concentration of the gas filling components fulfill the criteria as given above in the Table for a coldest spot temperature of 1400 K during nominal operation at 300 W. The gas filling components remain in the unsaturated state over at least part of the range of 300-150 W. At a coldest spot of about 1150 K, however, the concentration of NaI and $DyI_3$ is slightly above the values derived from the equation and indicated in Table 2 for z=1. With the amount of mercury indicated herein, all mercury is also in the gas phase during operation, even at 160 W.

Figure 6:
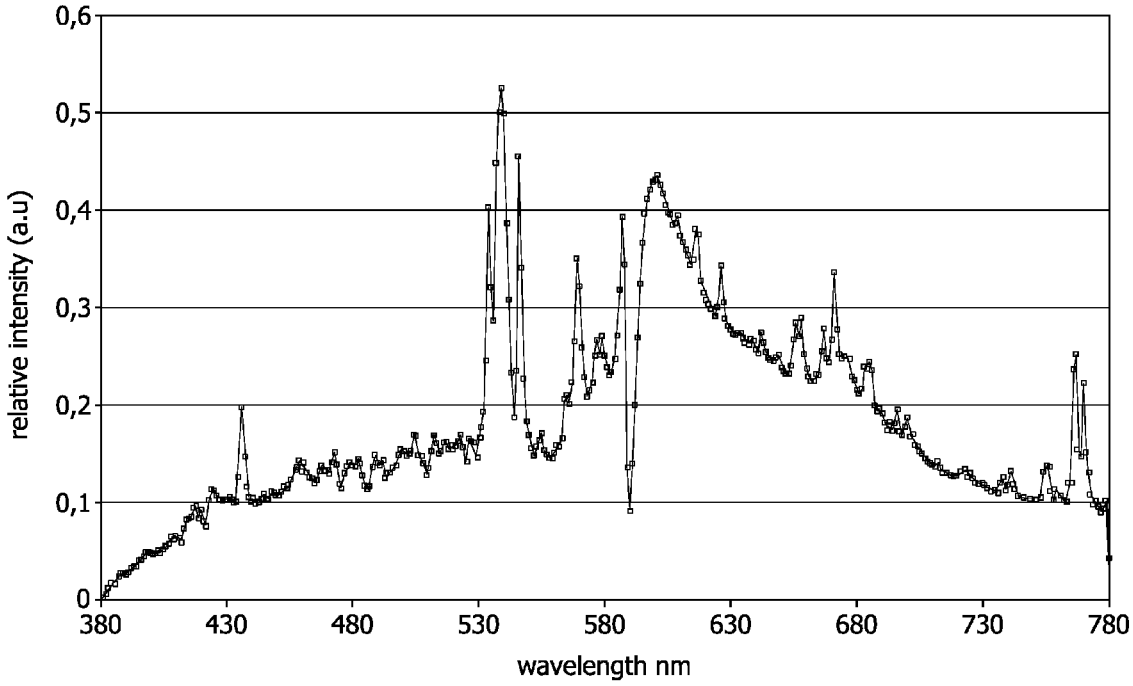
FIG. 6 shows a spectrum of a high-pressure discharge lamp based on iodides of Dy, Tl, and Na, the lamp having a color temperature of about 3350 K.

FIG. 6 shows the spectrum of the lamp described above when operated at 250 W. The photometric properties then are: Ra=96.4; the color index for 9 standard colors R9 is 67.5; the luminous efficacy is 83.2 lm/W, color temperature $T_c$=3336 K, and the CIE coordinates (x,y) are 0.4134, 0.3917.

Example 2

Dimming Behavior of the Lamp of Example 1

The dimmability (extent to which a lamp can be dimmed from intensity at nominal operation down to lower intensities) was measured for the lamp of example 2. It appears that within a range of 300-160 W the lamp can be dimmed without departing from a 5 SDCM range (which is a range that is acceptable for many applications). This means that dimming by at least 50% of the maximum intensity can be achieved.

It further appears that the dependency of photometric properties on the spatial orientation of the lamp (horizontal or vertical) is substantially smaller for the lamp according to the invention than for comparable prior art lamps.

Example 3

Example of Lamp/Discharge Vessel According to the Invention

Figure 10:
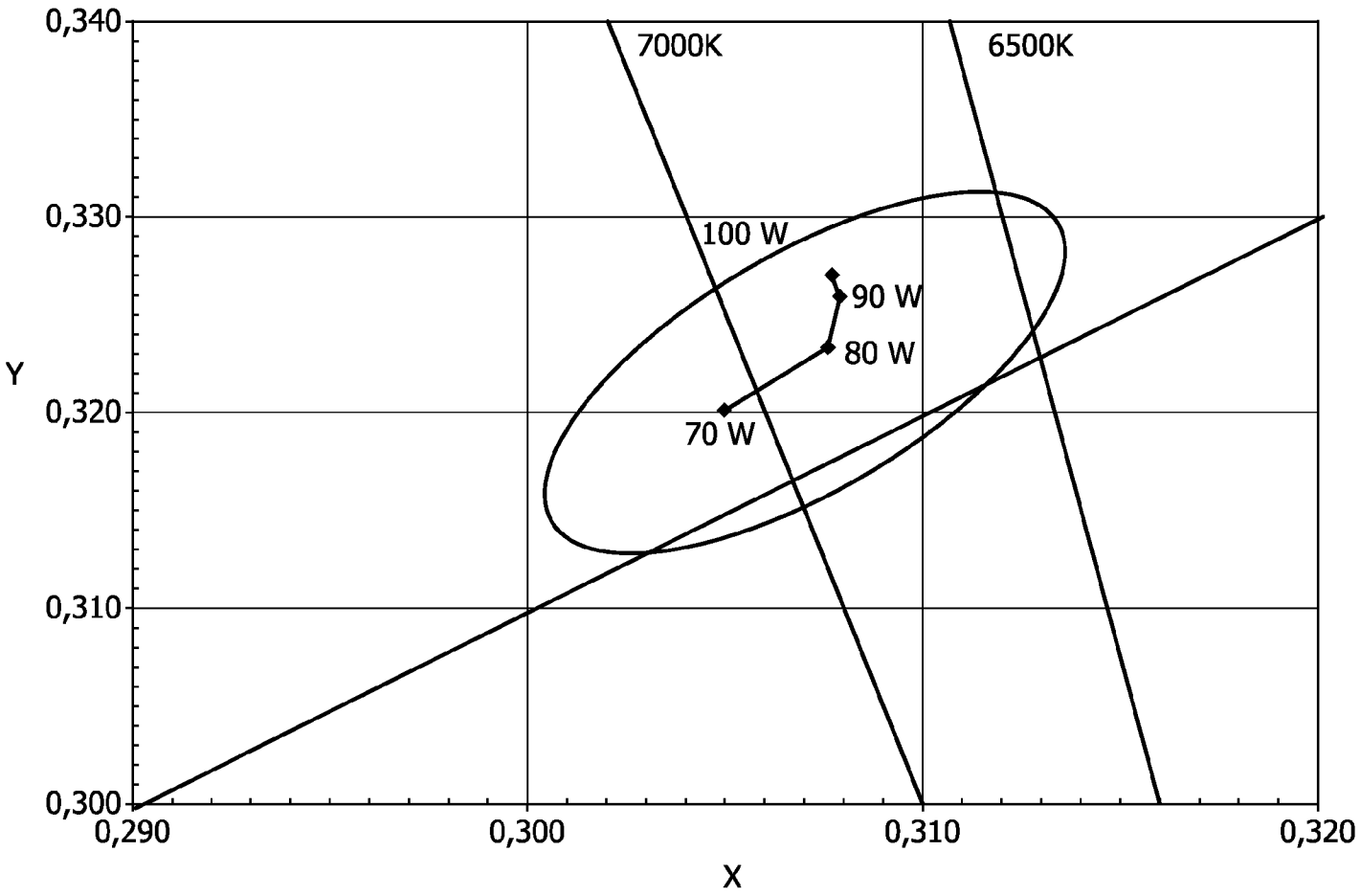
FIG. 10 shows the dimmability of the lamp of FIG. 9 at powers of 70-100 W. The ellipse indicates the 5 standard deviation of color matching (5 SDCM) range.
Figure 11:
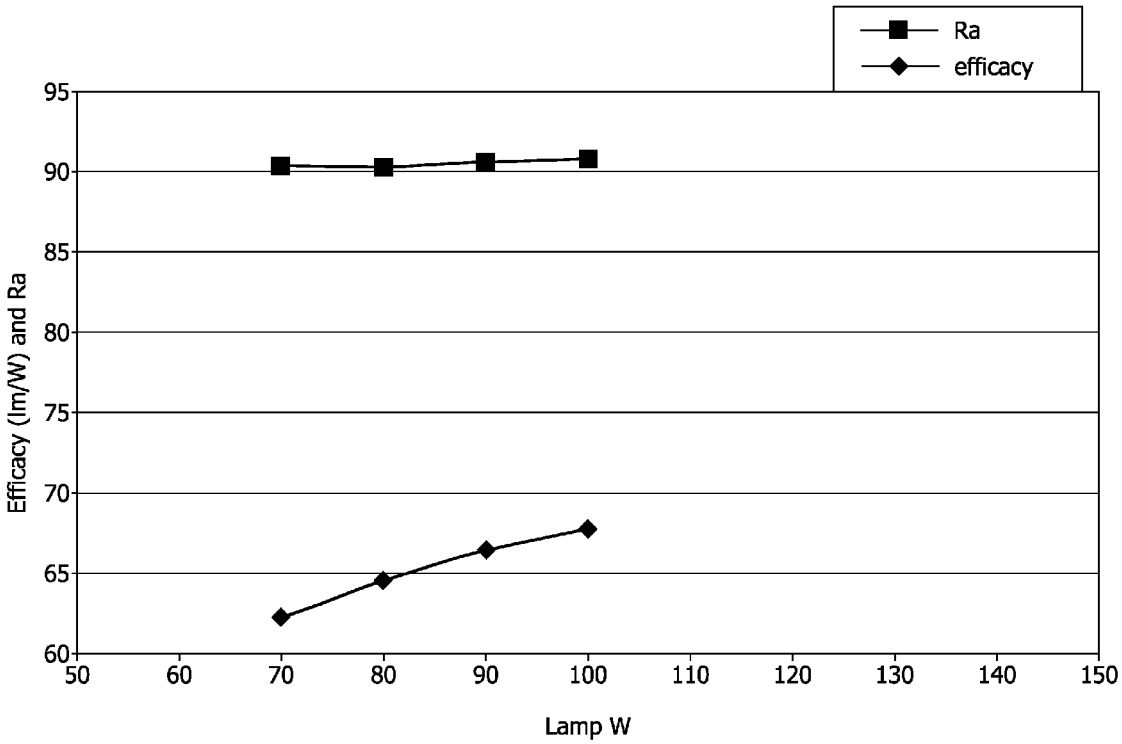
FIG. 11 shows the luminous efficacy and the general color rendering index (Ra) of the lamp of FIG. 9 at powers of 70-100 W.

A lamp with discharge vessel 3 having a volume of 0.32 $cm^3$ was made. The discharge vessel 3 contained the following filling: 600 μg InI, 4 mg Hg, and 300 mbar Ar. Thus the InI concentration is 1875 $\mu g/cm^3$, corresponding to a value for z at 1300K of 0.31 and at 1200K of 0.56. The lamp was operated at 220 V, 50 Hz, at room temperature. The coldest spot temperature at nominal power (100 W) was 1300 K (±50 K); at 70 W the coldest spot temperature was 1200 K. The color point, the general color rendering index (Ra), and the luminous efficacy as a function of the power are shown in FIGS. 10-11. The estimated wall load was about 40 $W/cm^2$. Hence, the InI concentration in this lamp is chosen such that InI is in the gas phase over the whole range of 70-100 W (resulting in a temperature range of 1200 K±1300 K).

Figure 9:
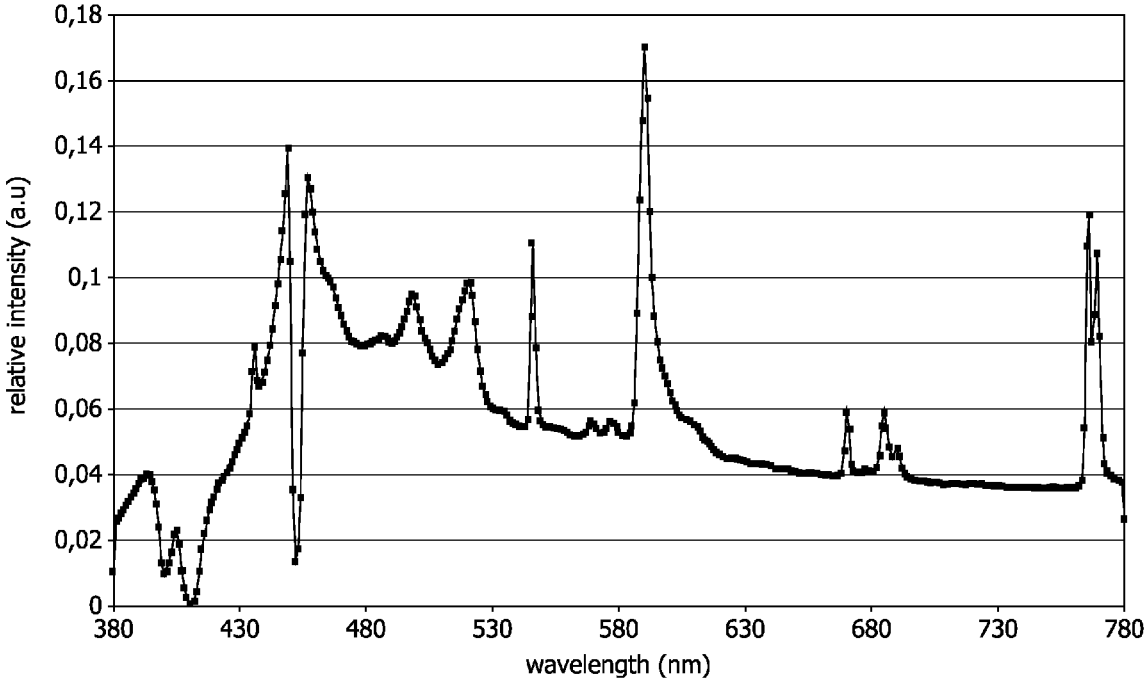
FIG. 9 shows a spectrum of a high-pressure discharge lamp based on iodides of In, the lamp having a color temperature of about 6800 K.

FIG. 9 shows the spectrum of the lamp described above when operated at 70 W. The photometric properties then are: Ra=90; R9 is 55; the luminous efficacy is 62.3 μm/W, the color temperature $T_c$=7040 K, and the CIE coordinates (x,y) are 0.3050, 0.3201.

Example 4

Dimming Behavior of the Lamp of Example 3

The dimmability (extent to which a lamp can be dimmed from maximum intensity (i.e. maximum power) down to lower intensities) was measured for the lamp of example 3. It appears that the lamp can be dimmed over a range of 100-70 W without departing from a 5 SDCM range (which is a range that is acceptable for many applications). This means that dimming by at least 30% of the maximum intensity can be achieved.

It further appears that also in this case the dependency of the photometric properties on the spatial orientation of the lamp (horizontal or vertical) is substantially less for the lamp according to the invention than for comparable prior art lamps.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware.

The mere fact that certain measures are recited in mutually different dependent claims does not indicate that a combination of these measures cannot be used to advantage.

The invention claimed is:

1. A metal halide lamp (1) comprising a ceramic discharge vessel (3), which discharge vessel (3) encloses a discharge volume (11), comprises two electrodes (4, 5), and contains an ionizable gas filling, the ionizable gas filling comprising one or more components selected from the group consisting of LiI, NaI, KI, RbI, CsI, $MgI_2$, $CaI_2$, $SrI_2$, BaI2, $ScI_3$, $YI_3$, $LaI_3$, $CeI_3$, $PrI_3$, $NdI_3$, $SmI_2$, $EuI_2$, $GdI_3$, $TbI_3$, $DyI_3$, $HoI_3$, $ErI_3$, $TmI_3$, $YbI_2$, $LuI_3$, InI, TlI, $SnI_2$ and $ZnI_2$, wherein the concentration h of the respective components in the discharge vessel (3) in $\mu g/cm^3$ fulfill the equation:

$$\log h = A/T_{cs}^2 + B/T_{cs} + C + \log z,$$

wherein $T_{cs}$ is the coldest spot temperature of discharge vessel (3) in Kelvin during nominal operation of the lamp (1), wherein A, B and C are defined as follows:

| Component | $A*10^{-6}$ | $B*10^{-3}$ | C |
|---|---|---|---|
| LiI | −0.51 | −5.88 | 7.16 |
| NaI | −1.30 | −5.82 | 6.99 |
| KI | −2.51 | −3.48 | 5.66 |
| RbI | −2.04 | −4.95 | 6.48 |
| CsI | −1.40 | −5.72 | 7.13 |
| $MgI_2$ | −1.92 | −4.40 | 8.20 |
| $CaI_2$ | −3.45 | −5.99 | 6.83 |
| $SrI_2$ | −1.99 | −9.33 | 8.05 |
| $BaI_2$ | −2.15 | −10.00 | 8.47 |
| ScI3 | −17.70 | 18.76 | 0.16 |
| $YI_3$ | −7.96 | 0.43 | 6.41 |
| $LaI_3$ | −4.24 | −4.66 | 6.98 |
| $CeI_3$ | −3.15 | −7.37 | 9.36 |
| $PrI_3$ | −1.98 | −7.86 | 8.43 |
| $NdI_3$ | −4.29 | −4.42 | 6.58 |
| $SmI_2$ | −1.62 | −11.20 | 9.71 |
| $EuI_2$ | −1.95 | −10.50 | 8.95 |
| $GdI_3$ | −9.69 | 4.26 | 3.62 |
| $TbI_3$ | −9.41 | 4.09 | 3.59 |
| $DyI_3$ | −11.90 | 6.42 | 4.68 |
| $HoI_3$ | −9.48 | 3.15 | 5.61 |
| $ErI_3$ | −12.10 | 6.54 | 5.46 |
| $TmI_3$ | −3.12 | −5.25 | 7.64 |
| $YbI_2$ | −1.33 | −10.10 | 8.45 |
| $LuI_3$ | −9.00 | 3.37 | 5.38 |
| InI | −1.30 | −2.02 | 6.11 |
| TlI | −1.36 | −2.92 | 7.01 |
| $SnI_2$ | −1.99 | −1.14 | 6.39 |
| $ZnI_2$ | −2.58 | 0.65 | 5.23 |

and wherein $T_{cs\ is\ at\ least}$ 1200 K and z is between 0.001 and 2, wherein the ionizable gas filling further comprises at least one of dysprosium iodide, cerium iodide or indium iodide.

2. The metal halide lamp (1) according to claim 1, wherein the filling comprises one or more elements selected from the group comprising Mg, Sc, Er, In. T1, Sn, Zn, Y, Dy, Ho, Lu, Li, Ce and Tm, wherein the concentration h of the respective components fulfill the equation of claim 1, wherein z is 0.5 or smaller for Mg, Sc, Er, In, TI, Sn and Zn, wherein z is 1.5 or smaller for Y, Dy, Ho, Lu and Li, and wherein z is 2 or smaller for Ce and Tm.

3. The metal halide lamp (1) according to claim 1 wherein z is equal to or smaller than 1.

4. The metal halide lamp (1) according to claim 1 wherein z is equal to or smaller than 0.5.

5. The metal halide lamp (1) according to claim I wherein $T_{cs}$ is at least 1300 K during nominal operation of the lamp (1).

6. The metal halide lamp (1) according to claim 1 wherein the discharge vessel (3) is arranged to have a minimum temperature $T_{cs}$ in the range of 1.350-1600 K during nominal operation of the lamp (1).

7. The metal halide lamp (1) according to claim 1 wherein the discharge vessel (3) of the lamp (1) further comprises one or more scalings (10).

8. The metal halide lamp (1) according to claim 7, wherein the ionizable gas filling contains one type of rare earths, wherein the sealing material of the one or more scalings (10) comprises a ceramic sealing material based on a mixture of aluminum oxide, silicon dioxide, and a rare earth oxide, and wherein the rare earth oxide of the sealing material is an oxide of the same rare earth element that is also comprised in the ionizable gas filling.

9. The metal halide lamp (1) according to claim 8, wherein the one rare earth element is Dy and wherein the one or more seal(s) (10) is or are based on a mixture of aluminum oxide, silicon dioxide, and dysprosium oxide.

10. The metal halide lamp (1) according to claim 8, wherein the one rare earth element is Ce and wherein the one or more seal(s) (10) is or are based on a mixture of aluminum oxide, silicon dioxide, and cerium oxide.

* * * * *